US011174651B1

(12) United States Patent
Fischer

(10) Patent No.: US 11,174,651 B1
(45) Date of Patent: Nov. 16, 2021

(54) TENSIONING SYSTEM AND METHOD

(71) Applicant: Frank Fischer, Green Pond, NJ (US)

(72) Inventor: Frank Fischer, Green Pond, NJ (US)

( * ) Notice: Subject to any disclaimer, the term of this patent is extended or adjusted under 35 U.S.C. 154(b) by 0 days.

(21) Appl. No.: 16/916,302

(22) Filed: Jun. 30, 2020

(51) Int. Cl.
*E04G 21/12* (2006.01)
*E04C 5/12* (2006.01)
*E02D 27/42* (2006.01)

(52) U.S. Cl.
CPC ..... *E04G 21/12* (2013.01); *E04C 5/12* (2013.01); *E02D 27/42* (2013.01)

(58) Field of Classification Search
CPC .... E04B 1/4121; E04B 1/4164; E04B 1/4157; E04C 5/12; E04C 5/122; E04H 17/10; E04H 17/12; E04H 17/24; E04H 17/266; E04F 11/1804; E04F 11/1859; E04G 21/3204; E04G 21/3219; E04G 21/3223; E04G 21/12; E21D 21/008
USPC ..... 256/33, 37, 56
See application file for complete search history.

(56) References Cited

U.S. PATENT DOCUMENTS 465,169 A * 12/1891 Eckley ..... E04H 17/08 256/37
2,783,024 A * 2/1957 Lee ..... E04C 5/122 254/29 A
3,049,368 A * 8/1962 Jansen ..... E04C 5/122 403/365
3,811,652 A 5/1974 De Valenzuela
4,192,215 A * 3/1980 Hymans ..... E04C 5/122 24/122.6
4,744,691 A 5/1988 Thal
5,489,056 A 2/1996 Staschewski
5,525,013 A 6/1996 Seegmiller et al.
5,630,301 A 5/1997 Sieg
5,718,090 A 2/1998 Wei-Hwang
7,716,800 B1 * 5/2010 Percheron ..... E04C 5/122 29/413
8,740,504 B2 6/2014 Oldsen et al.
9,062,457 B2 * 6/2015 Gilling ..... E21D 21/0086
10,718,124 B1 * 7/2020 Blanco ..... E04G 17/0642
(Continued)

FOREIGN PATENT DOCUMENTS

EP 0322317 A1 * 6/1989 ..... E04C 5/122
GB 704094 A * 2/1954 ..... E04C 5/12
GB 2529964 B * 7/2016 ..... E04H 17/10

*Primary Examiner* — Christine T Cajilig
(74) *Attorney, Agent, or Firm* — Thomas L. Adams

(57) ABSTRACT

A system can tension a cable that is to be strung through a plurality of columns. The tensioning system is disposed at the last column and includes a spacing device and a barrel with a tapered cavity. A number of tapered elements are slidably mounted in the barrel's cavity and will encompass the cable and favor unidirectional movement of the cable. The barrel and the tapered elements have opposite openings that allow the cable to emerge from opposite ends thereof. With the barrel at the outward side of the last one of the plurality of columns, the cable is pulled through the tapered elements, away from the plurality of columns. Next, at a side opposite the outward side of the last column, the cable is grasped and pulled away from the barrel to seat the tapered elements. Working again on the outward side, the barrel is then moved away from the last column. The spacing device is applied at the barrel to set the spacing between the barrel and the last column.

20 Claims, 7 Drawing Sheets

(56) References Cited

U.S. PATENT DOCUMENTS

| | | | | |
|---|---|---|---|---|
| 2007/0175128 | A1* | 8/2007 | McCallion | E04C 5/122<br>52/223.13 |
| 2009/0191006 | A1 | 7/2009 | Seegmiller | |
| 2009/0191007 | A1* | 7/2009 | Seegmiller | E21D 21/008<br>405/259.5 |
| 2018/0094450 | A1* | 4/2018 | Sorkin | E04H 17/06 |

* cited by examiner

TENSIONING SYSTEM AND METHOD

BACKGROUND OF THE INVENTION

1. Field of the Invention

The present invention relates to systems and methods for tensioning cables on columns that are part of a structure.

2. Description of Related Art

There is often the need to tension cables. For example, in a parking garage a series of concrete columns may be used to support a number of cables that are strung through these columns and act as a barrier. It is important to have the proper amount of tension on these cables if they are to be used as a barrier for stopping vehicles.

A known device for applying tension to such a cable employs a socket containing wedges that allow for easy insertion of the cable, but a gripping effect that prevents removal. A threaded arrangement mounted on the inside end of this socket can be screwed onto an element embedded in a concrete column. This screwing can be used to increase the tension in the cable held in the socket. A disadvantage with this arrangement is that the cable length must be carefully chosen to achieve the desired final tension. Also, this mechanical device has a tendency to break off from the column for impacts close to the device.

The device commonly used for tensioning cables is a conical insert slidably mounted in the conical cavity of a barrel. The conical insert can be separate, longitudinally divided elements, or a conical arrangement with longitudinal slits that project from a continuous base. These conical inserts are designed to fit closely around a cable. When the cable is pulled in the direction toward the wide opening of the barrel's conical cavity, the elements of the conical insert can loosen their grip on the cable, allowing the cable to slide. When the cable is pulled in the opposite direction, the conical insert are driven inwardly and acts like a wedge that clamps onto the cable, preventing its movement.

After a cable is strung through holes in concrete columns, these known barrels with their conical inserts can be installed on the cable on the outward side of the first and the last column. These conical inserts are oriented to allow the cable to be pulled away from the other columns. Accordingly, pulling on one end of the cable at, say, the outside of the last column will allow passage of the cable through this last column, but the cable will be locked in place at the first column. The cable can be pulled using a hydraulic device such as a stressing jack commercially available from Precision-Hayes located in Seagoville, Tex.

When the initial pulling tension is relieved, there is a tendency for the conical inserts at the pulling location to retreat back into the barrel, allowing the cable to loosen somewhat. Also, there is a tendency for the conical inserts to retreat but not fully seat themselves in the barrel's conical cavity. It is desirable to fully seat these conical inserts, and for that reason an installer may often place a hydraulic pulling device on the inside of the last column and pull the cable inwardly toward the other columns to fully seat the conical inserts. These operations allow the cable to loosen in such a way that the installer does not have accurate control of the ultimate cable tension.

Accordingly, there is a need for devices and methods to correct for this loss in tension, in order to make the overall tensioning arrangement more reliable and accurate.

See also U.S. Pat. Nos. 3,811,652; 4,744,691; 5,489,056; 5,525,013; 5,630,301; 5,718,090; 8,740,504; as well as U.S. Patent Application Pub. No. 2009/0191006.

SUMMARY OF THE INVENTION

In accordance with the illustrative embodiments demonstrating features and advantages of the present invention, there is provided a tensioning system for a cable that is to be strung through a plurality of columns and terminated at a last one of the plurality of columns. The tensioning system is disposed at the last one of the plurality of columns and includes a barrel having a tapered cavity. The tensioning system also includes a wedging arrangement and a spacing device. The wedging arrangement has a plurality of tapered elements slidably mounted in the tapered cavity of the barrel. The plurality of tapered elements are adapted to encompass the cable and are oriented to favor unidirectional movement of the cable through the plurality of tapered elements. The wedging arrangement has opposite openings that allow the cable to emerge from opposite ends of the wedging arrangement. The spacing device can engage the barrel and the last one of the plurality of columns without directly engaging the cable. The spacing device is adjustable to set the spacing between the barrel and the last one of the plurality of columns.

In accordance with another aspect of the invention, a tensioning method is provided for a cable that can reach between a first one and a last one of a plurality of columns. The first one and the last one of the plurality of columns each have an outward side facing away from the plurality of columns. The cable has a given end and a countervailing end. The method employs a mechanically adjustable spacing device and a plurality of tapered elements that are slidably mounted inside a barrel. The method includes the step of stringing the cable through the plurality of columns with the countervailing end of the cable being secured to the first one of the plurality of columns. Also, the given end of the cable is strung about the last one of the plurality of columns. The method also proceeds, with the barrel at the outward side of the last one of the plurality of columns, to pull the cable. The cable is pulled through the plurality of tapered elements to move the given end of the cable away from the plurality of columns. The method also proceeds, at a side opposite the outward side of the last one of the plurality of columns, to grasp the cable and pull it away from the barrel to seat the plurality of tapered elements. The method also includes the step of moving the barrel in a direction away from the last one of the plurality of columns. Another step is applying the spacing device at the barrel to set the spacing between the barrel and the last one of the plurality of columns.

In a disclosed embodiment, a series of columns are mounted in the floor structure of a building such as a parking garage. The first and last column of this series each has a recess on its outward side. Each recess contains a wedging arrangement that encompasses the cable and allows the cable to readily slide in the outward direction, which will cause tightening of the cable. The wedging arrangement restricts inward motion that would tend to loosen the cable.

The disclosed wedging arrangement employs a number of closely fitting, tapered elements that surround the cable. The tapered elements are slidably mounted in the conical cavity of a barrel. When the cable is pulled towards the wide end of the conical cavity, the tapered elements loosen and allow the cable to slide through these elements. Cable motion in the opposite direction urges these tapered elements towards the narrower part of the conical cavity, where they bear more tightly on the cable to prevent its motion.

Either end of the cable can be pulled outwardly with a hydraulic stressing jack to increase the cable tension between the first and last column. The tapered elements can then be firmly set around the cable by backsressing the cable at the first and last column. Specifically, a hydraulic jack can be used to pull the cable inwardly in order to set the tapered elements in the barrel. However, this backstressing will reduce the tension in the cable.

To counter this loss in tension, the disclosed embodiment connects a retraction device to one of the barrels containing the tapered elements. This retraction device can be used to pull the barrel outwardly using, for example, a mechanical arrangement that connects to the retraction device. In the disclosed embodiment the retraction device has a sleeve that connects to the barrel and is inserted through a brace that bears on the outside of the column. A nut that is threaded on the sleeve bears against the brace that in turn bears against the outside face of the column. Accordingly, the disclosed nut can be turned to pull the sleeve outwardly through the brace in order to move the barrel away from the column and increase the cable tension.

A disclosed spacing device is now applied to the barrel to keep it and the tapered elements in the retracted position so the restored cable tension is not lost. In one embodiment a threaded collar is pre-installed on the barrel. Once the barrel has been retracted, the threaded collar can be turned to extend and press against the column, thereby maintaining the barrel in the retracted position. In another embodiment, one or more tapered shims are inserted between the barrel and the column. The tapered shims (or shim) can be wedged between the barrel and column to take up the space between them so the barrel cannot retreat and loosen the cable.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
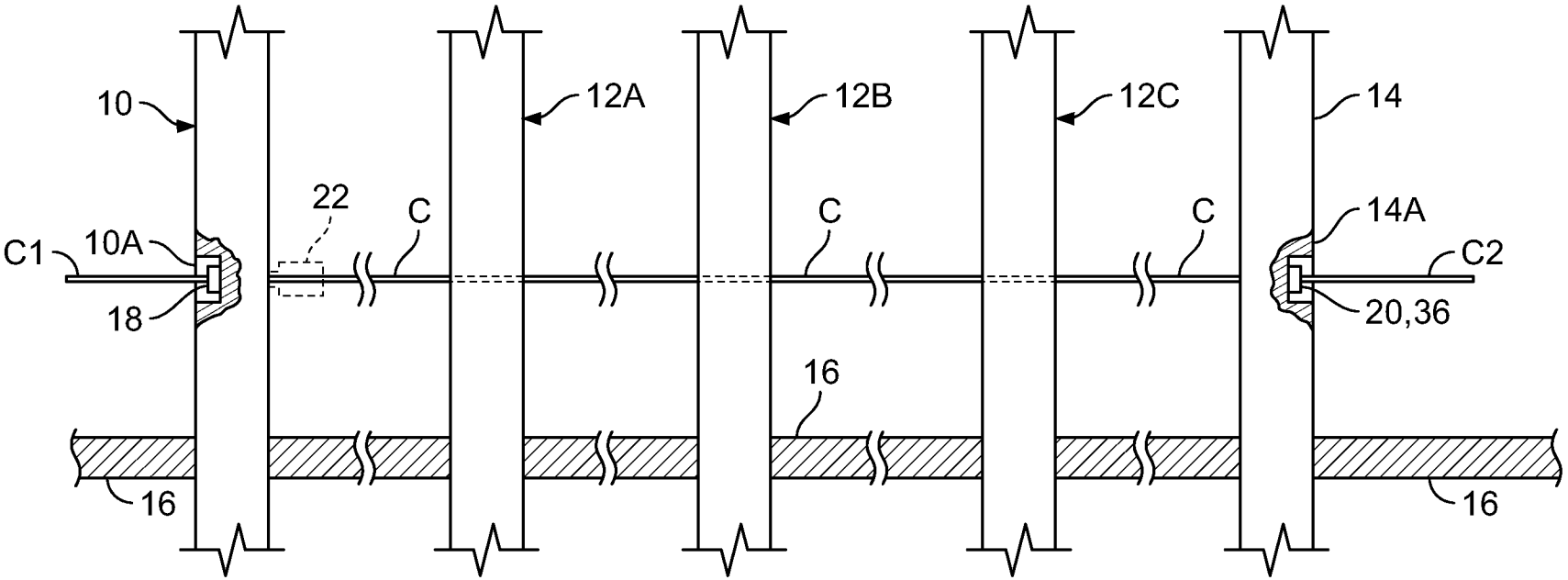
FIG. 1 is an elevational view of a cable strung through a plurality of columns in accordance with the present tensioning system and method.

Referring to FIG. 1 a plurality of columns 10, 12A, 12B, 12C, and 14 are mounted in floor 16 of a structure such as a parking garage. While five columns are shown, other embodiments may have a greater or smaller number. Column 10 is referred to herein as the first one of a plurality of columns. Column 14 is referred to herein as the last one of a plurality of columns. The terms first and last are arbitrary and do not indicate a priority in time, position, or importance. In embodiments having only two columns these two columns are still considered to be a plurality of columns.

The sides of columns 10 and 14 facing away from each other and the other illustrated columns are referred to herein as the outward sides. For a two column embodiment, the outward side of one column is considered facing away from itself and the other column (that is, facing away from the plurality of columns). The sides of the columns 10 and 14 opposite the outward sides are considered to be located on the inside.

Cable C is shown routed through columns 10, 12A, 12B, 12C, and 14. End C2 of cable C is referred to herein as the given end, while end C1 of cable C is referred to herein as the countervailing end. In some embodiments cable C may be a tendon with separate metal strands inside a metal sheath that has a galvanized surface. It will be appreciated that various other types of cables may be used instead.

Cable C is routed through holes (not shown) in columns 12A, 12B, and 12C. The countervailing end C1 of cable C is routed through recess 10A of column 10 and through device 18, in a manner that will be described presently. The given end C2 of cable C is routed through recess 14A of column 14 and through devices 20 and 36, in a manner that will be described presently.

As explained further hereinafter, the foregoing represents a system and method for tensioning cable C.

Figure 2:
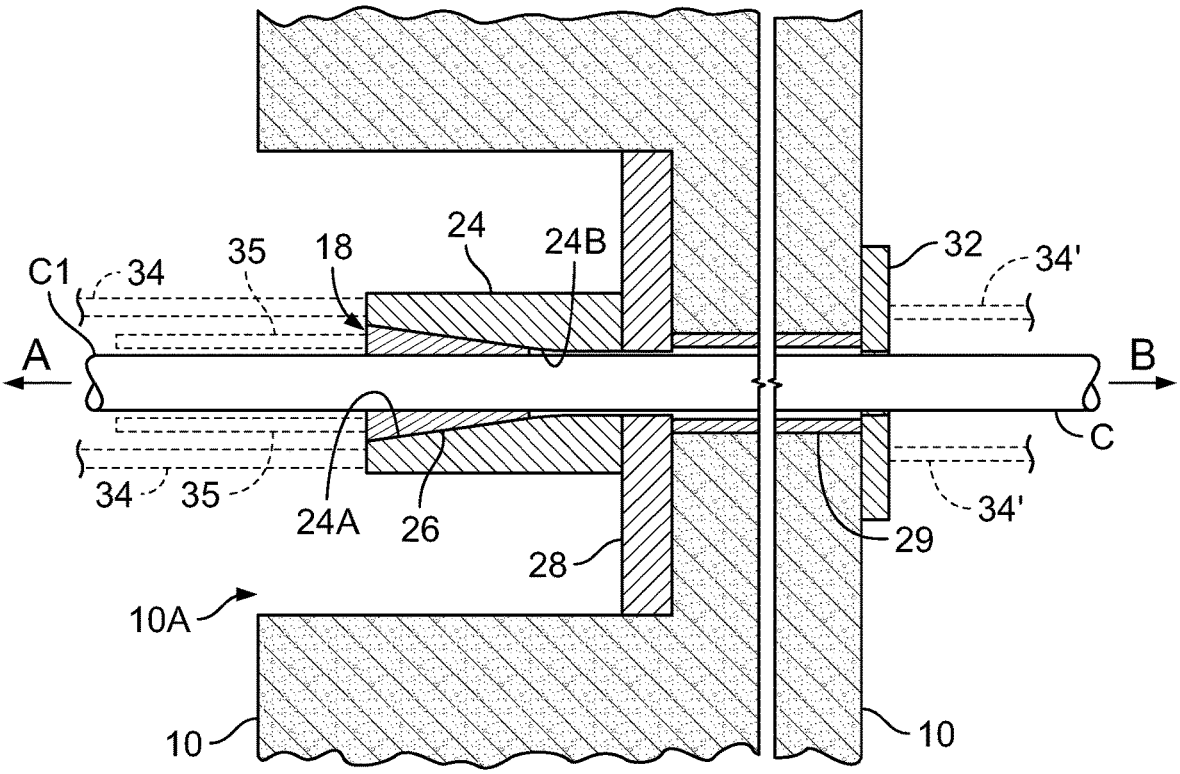
FIG. 2 is a fragmentary, vertical sectional view taken at the leftmost column of FIG. 1, and showing the details of the cable attachment.
Figure 3:
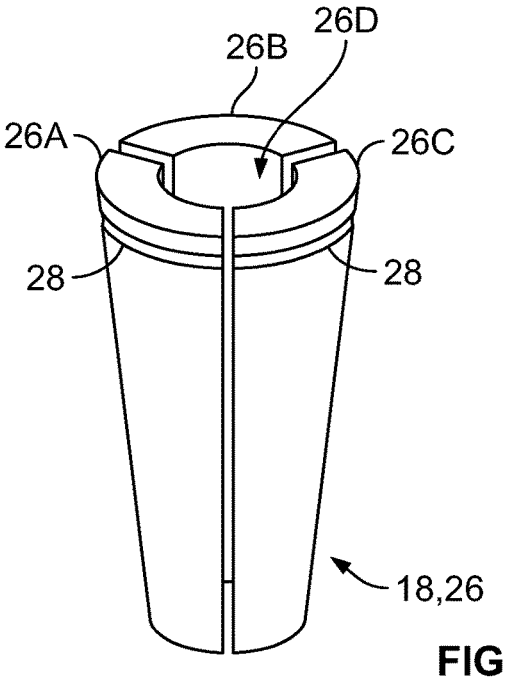
FIG. 3 is a perspective view of the tapered elements of FIG. 2 with their axes vertically oriented.

Referring to FIGS. 2 and 3, an annular plate 28 is placed at the end of recess 10A. In this embodiment plate 28 is circular and recess 10A is cylindrical, although in other embodiments plate 28 can be oval or polygonal and recess 10A can be shaped accordingly. A PVC pipe 29 lines the passage through which cable C is routed. Plate 28 and liner 29 can be cast in place when column 10 is fabricated.

A wedging arrangement 18 has a plurality of tapered elements 26, shown in FIG. 3 as three identical, equiangular elements 26A, 26B, and 26C that can be made of steel or other rigid materials. It will be appreciated that other embodiments may employ a greater or lesser number of tapered elements. Together, tapered elements 26 have a conical outside surface and surround a central cylindrical passage 26D. Tapered elements 26 are shown in FIG. 2 slidably fitted in the tapered (conical) cavity 24A of barrel 24. Tapered cavity 24A leads to a cylindrical conduit 24B through which cable C passes. Barrel 24 has a cylindrical outside surface, although other shapes may be employed in other embodiments.

As shown in FIG. 3, the wide end of each of the tapered elements 26A, 26B, and 26C has a circumferential groove 28. One or more turns of wire can be placed in grooves 28 to keep the wide ends of the tapered elements 26 together. In some embodiments the tapered elements may be part of a unitary conical structure that has a number of longitudinal slots that start at the tip of the device, but do not intersect the wide end. Therefore, the wide end is essentially a solid ring that holds the tapered elements and allows them to deflect somewhat.

The inside end of barrel 24 is shown pressed against plate 28. Cable C is shown routed through tapered elements 26, conduit section 24B of barrel 24, the central aperture of plate 28, pipe 29, and washer 32. Arranged in this manner, cable C can be pulled in the direction indicated by arrow A. When pulling is performed in this direction, tapered elements 26 will tend to move slightly in the same direction as arrow A, which will loosen their grip on cable C. If cable C is pulled in the opposite direction as indicated by arrow B, the cable will tend to pull tapered elements 26 deeper into cavity 24A. This causes the elements 26 to tightly grip cable C, which essentially prevents movement of the cable in the direction indicated by arrow B. Since arrangement 18 favors motion in the direction of arrow A, movement in this favored direction is referred to herein as a unidirectional movement.

As described further hereinafter, a similar wedging arrangement is fitted on the opposite end of the cable (at column 14 of FIG. 1). In FIG. 1 this other wedging arrangement is schematically illustrated as devices 20, 36 mounted in recess 14A, and described further hereinafter. Accordingly, pulling cable C through wedging arrangement 18 (FIG. 2) will apply tension to the cable, and the cable will not lose that tension because cable end C2 (FIG. 1) will be held in place by devices 20, 36.

In FIG. 2 the end C1 of cable C can be pulled in the direction of arrow A using a hydraulic device such as a stressing jack commercially available from Precision-Hayes, located in Seagoville, Tex. This jack has a gripper that can initially hold end C1 of cable C at a predetermined distance from wedging arrangement 18. The jack has a nose, schematically illustrated as tube 34 in FIG. 2.

Nose 34 will be extended hydraulically to press against barrel 24, which causes the jack's gripper to move outwardly and pull cable C through the tapered elements 26 in the direction of arrow A. In this embodiment the initial tension thus applied to cable C is 3 KIPS (3,000 pounds), although this initial force may differ depending upon the rating of the cable, the length of the cable, and the other physical constraints in the working environment. After the pressure on nose 34 is relieved, the stressing jack urges tubular wedge setter 35 against the tapered elements 26 to drive them deeper into the conical cavity 24A (this operation being referred to as "setting" the tapered elements). Nose 34 and wedge setter 35 each have slits that allow them to be placed over and around cable C.

While element 35 has set the tapered elements 26 to some extent, it is highly desirable to set them more firmly. Accordingly nose 34' of a stressing jack is now placed against washer 32 and the jack will again grip cable C. As before, nose 34' will be extended hydraulically and the jack's cable gripper will pull the cable in the direction indicated by arrow B. Consequently, cable C will pull tapered elements 26 more deeply into conical cavity 24A. In some embodiments washer 32 will be split and the resulting C shape will allow an installer to place the washer around cable C temporarily, and remove the washer when it is no longer needed.

Figure 4:
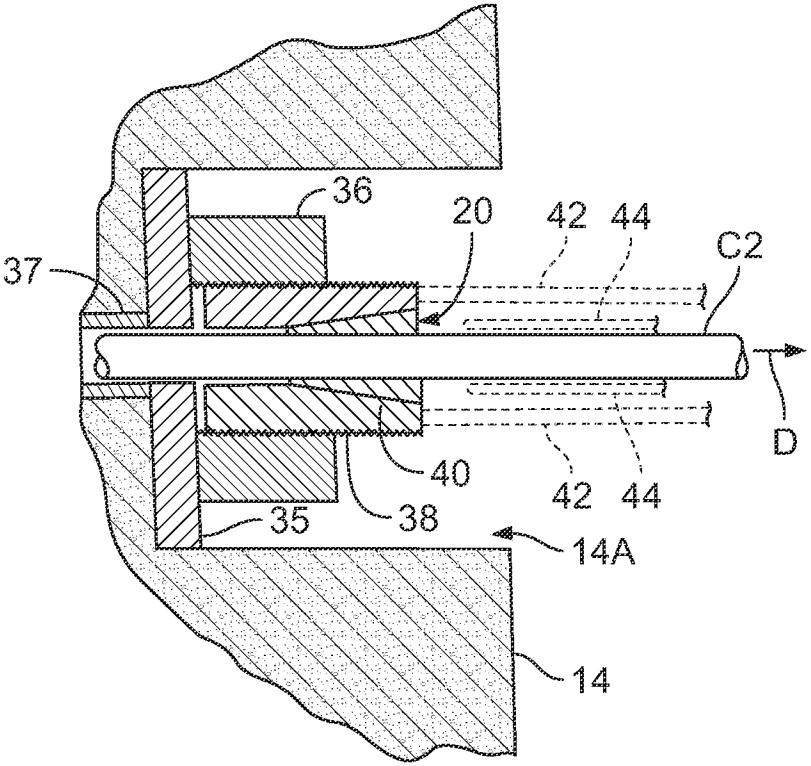
FIG. 4 is a fragmentary, vertical sectional view taken at the rightmost column of FIG. 1, and showing the details of the cable attachment.

Referring now to FIG. 4, the other end C2 of cable C is shown routed through recess 14A of column 14. As before, annular plate 35 and liner pipe 37 are cast in place when column 14 is fabricated.

Wedging arrangement 20 has a plurality of tapered elements 40 (see FIG. 3) mounted inside the tapered cavity of barrel 38. This device is the same as the previously described device (components 18 and 24 of FIG. 2), except that barrel 38 has external threads. Barrel 30 is screwed into spacing device 36, which is shown as an internally threaded collar pressed against annular plate 35. Wedging arrangement 20 facilitates unidirectional movement of cable C as indicated by arrow D.

The end C2 of cable C can be pulled in the direction of arrow D using the previously mentioned stressing jack. The jack's cable gripper can hold end C2 of cable C at a predetermined distance from wedging arrangement 20. As before, nose 42 will be extended hydraulically to press against barrel 38, which causes the jack's gripper to pull cable C through the tapered elements 40 in the direction of arrow D. At this stage the tension applied to cable C is 3.5 KIPS (3,500 pounds), although this force may differ depending upon the cable, its length, and other environmental factors. After the pressure on nose 42 is relieved, the stressing jack urges tubular wedge setter 44 against the tapered elements 40 to drive them deeper into the conical cavity of barrel 38.

Figure 5:
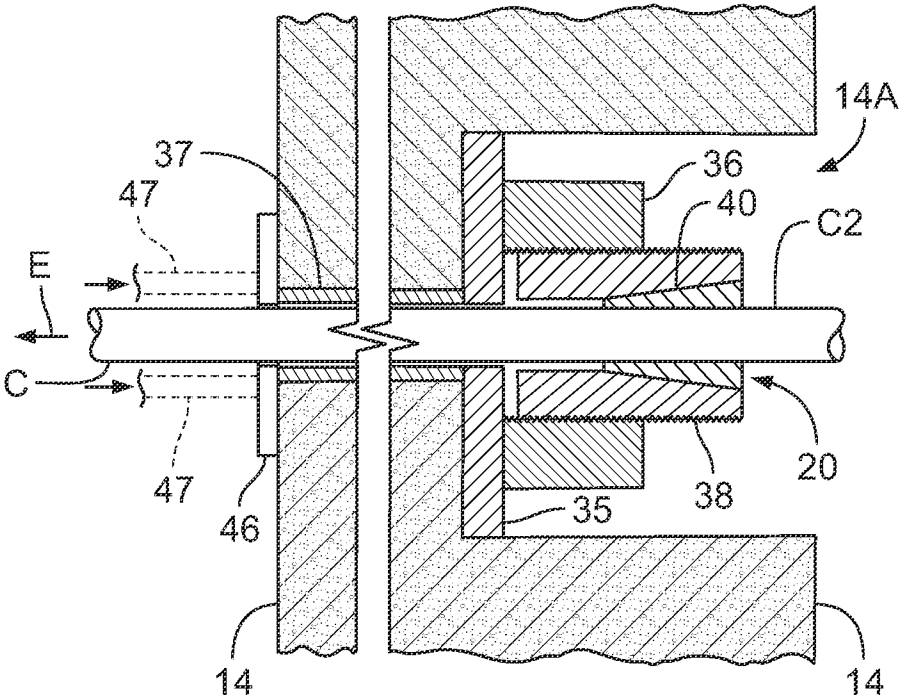
FIG. 5 is a fragmentary, vertical sectional view of the arrangement of FIG. 4 and showing details of the backstressing of the cable performed at the inside of the column.

Referring to FIG. 5, the setting of tapered elements 40 will now be enhanced. Specifically, nose 47 of a stressing jack is now placed against washer 46 and the jack will again grip the cable C. As before, nose 47 will be extended hydraulically and the jack's cable gripper will pull the cable in the direction indicated by arrow E. Consequently, cable C will pull tapered elements 40 more deeply into the conical cavity of barrel 38. The foregoing setting operation has moved cable C inwardly, but in doing so, has reduced the cable tension.

Figure 6:
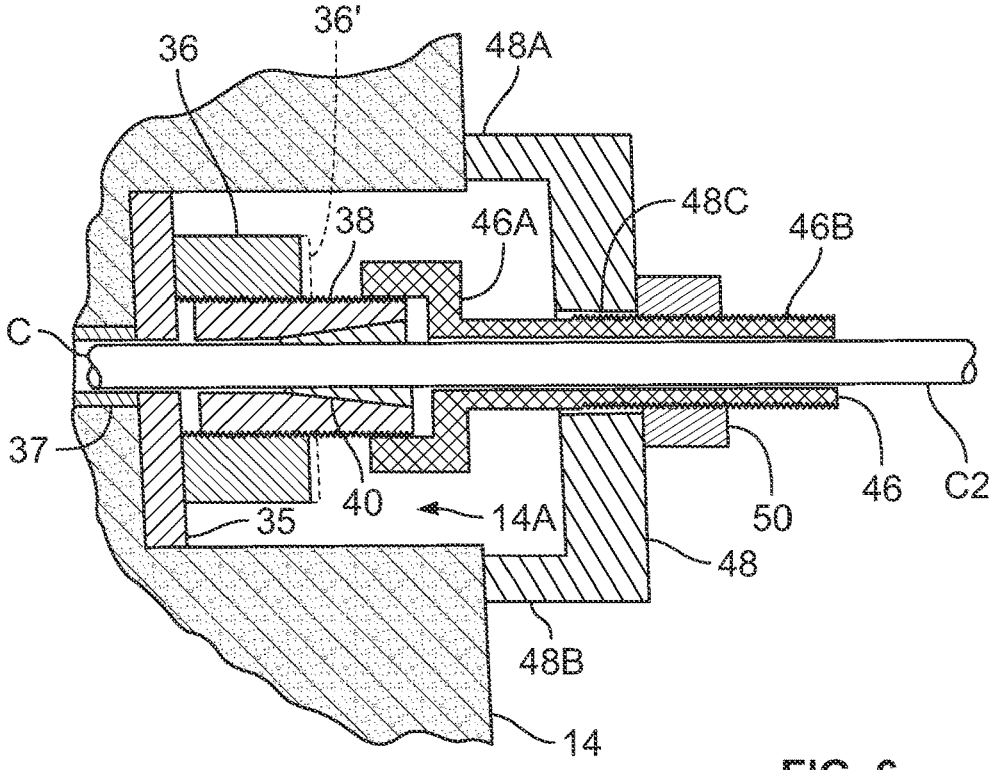
FIG. 6 is a fragmentary, vertical sectional view of the arrangement of FIG. 5 showing the application of a retraction device.
Figure 7:
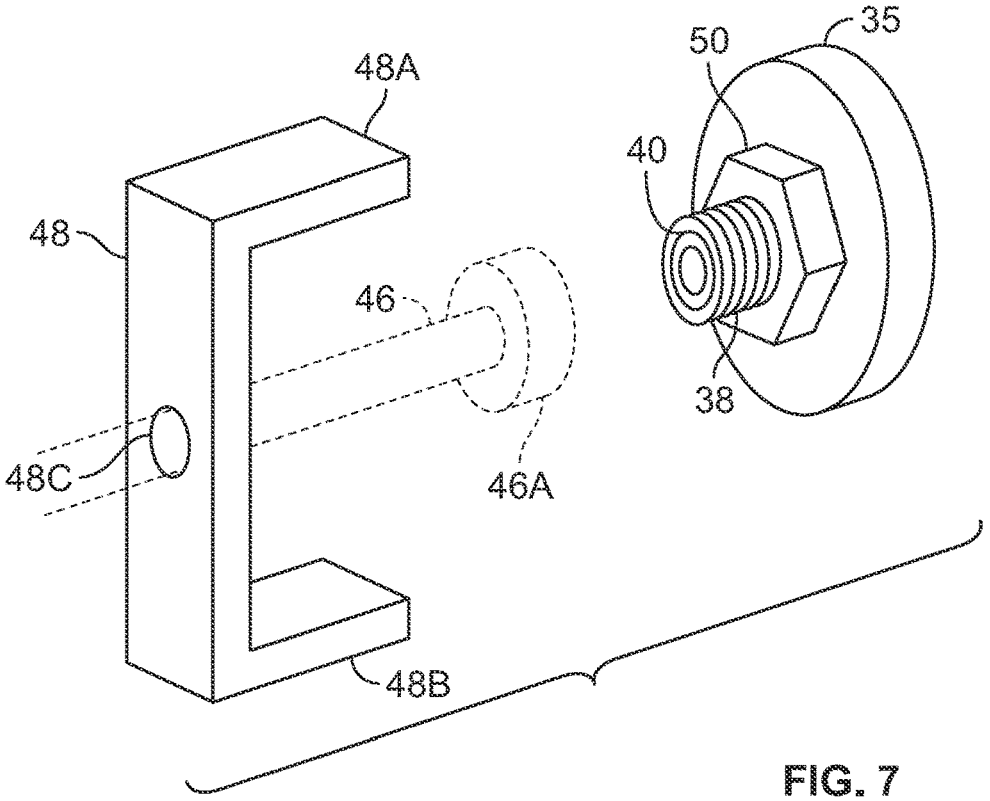
FIG. 7 is a detailed, perspective view of portions of the retraction device of FIG. 6, and showing its relation to the barrel and spacing device of FIG. 6.

Referring to FIGS. 6 and 7, a retraction device has been deployed at column 14 to restore cable tension. The retraction device has a sleeve 46 with an enlarged, internally threaded cup 46A screwed onto barrel 38. Sleeve 46 is inserted through bore 48C of a C-shaped yoke 48, which is also part of the retraction device. Yoke 48 is shown as a brace with arms 48A and 48B that can bear against column 14 to the outside of recess 14A.

Nut 50 is screwed onto the external threads 46B of sleeve 46 at the outside of brace 48. Tightening nut 50 will pull sleeve 46 outwardly, which will in turn pull barrel 38 and spacing device 36 outwardly. This motion of barrel 38 causes tapered elements 40 to pull cable C outwardly and restore tension, for example, bringing the tension to 3 KIPS (3,000 pounds).

This outward motion is indicated as the retracted position 36', shown in phantom. To keep barrel 38 in this newly retracted position, spacing device 36 is turned to bring its inner face to the position illustrated in full lines in FIG. 6, that is, bearing against annular plate 35. Device 36 can be turned with an appropriate spanner, such as a crow foot wrench.

Thereafter, nut 50 can be removed so that brace 48 can be taken off sleeve 46. Thereafter, cup 46A of sleeve 46 will be unscrewed and removed from barrel 38. Finally, cable C can be trimmed and coated with a galvanizing compound such as a Z.R.C.®, or Galvanox® coating. Thereafter recess 14A can be filled with grout or sealed with a cover plate (not shown). Cable C will also be trimmed at column 10 (FIG. 2) before closing recess 10A with either grout or a cover plate.

Figure 8:
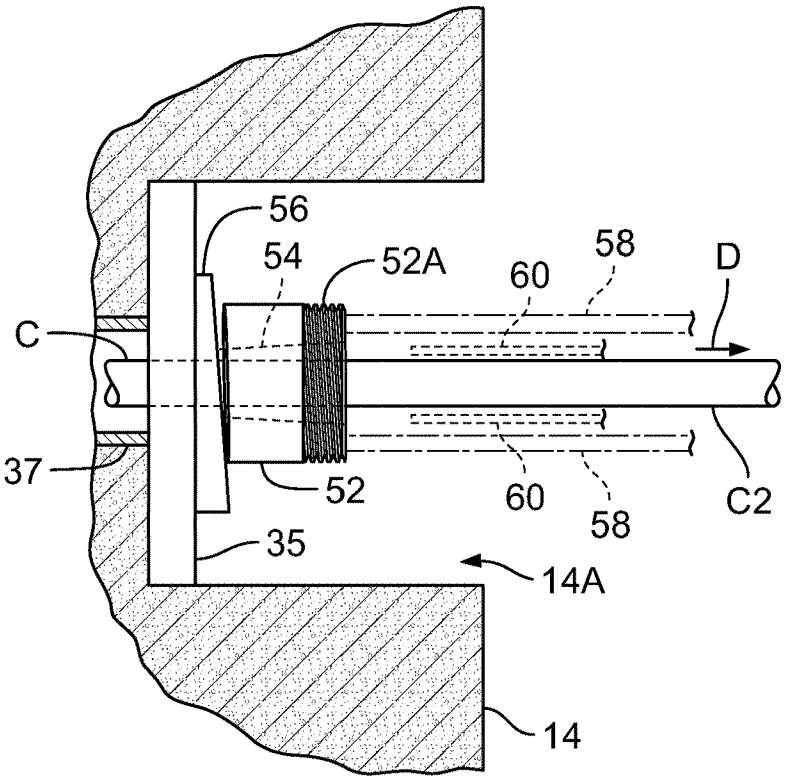
FIG. 8 is a fragmentary, vertical sectional view of an arrangement that has a spacing device that is an alternate to that shown in FIG. 4.

Referring to FIG. 8, the barrel previously described in FIG. 4 for column 14 has been replaced with a shorter barrel 52. Barrel 52 has a conical cavity containing tapered elements 54, which are similar to those illustrated in FIG. 3. Barrel 52 has external threads 52A, but limited to only a distal portion of the barrel.

An annular tapered shim 56 is mounted around cable C between barrel 52 and previously mentioned plate 35. Shim 56 is shown in further detail in FIG. 10.

In an operation similar to that described in connection with FIG. 4, FIG. 8 shows a stressing jack being applied to cable C to pull it in the direction of arrow D. As before, nose 58 will be extended hydraulically to press against barrel 52, which causes the jack's gripper to pull cable C through the tapered elements 54 in the direction of arrow D. At this stage the tension applied to cable C is 3.5 KIPS (3,500 pounds), although this force may differ depending upon the cable, its length, and other environmental factors. After the pressure on nose 58 is relieved, the stressing jack urges tubular wedge setter 60 against the tapered elements 54 to drive them deeper into the conical cavity of barrel 52.

Using the backstressing procedures previously described in connection with FIG. 5, tapered elements 54 will now be set more firmly (this backstressing is not separately illustrated, but corresponds to that performed in connection with FIG. 5). As before, a jack's nose will be extended hydraulically, while its cable gripper pulls the cable inwardly, away from column 14 in order to set tapered elements 54 more deeply into the conical cavity of barrel 52. The foregoing setting operation has moved cable C inwardly and consequently reduced the cable tension.

Figure 9:
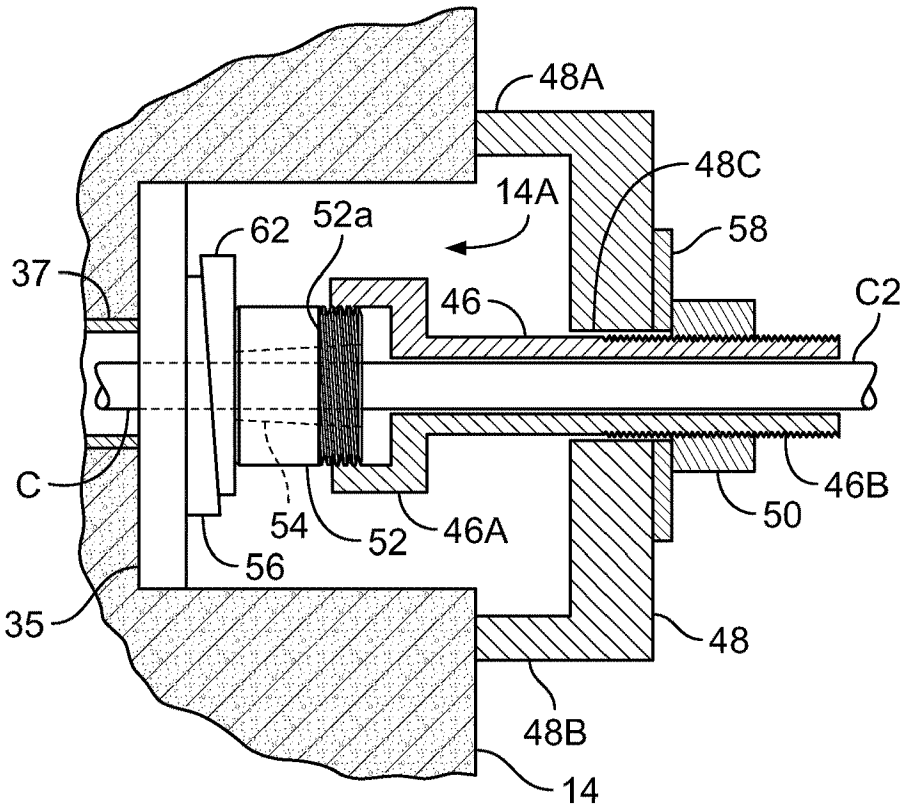
FIG. 9 is a fragmentary, vertical sectional view of the arrangement of FIG. 8 showing the application of a retraction device.
Figure 10:
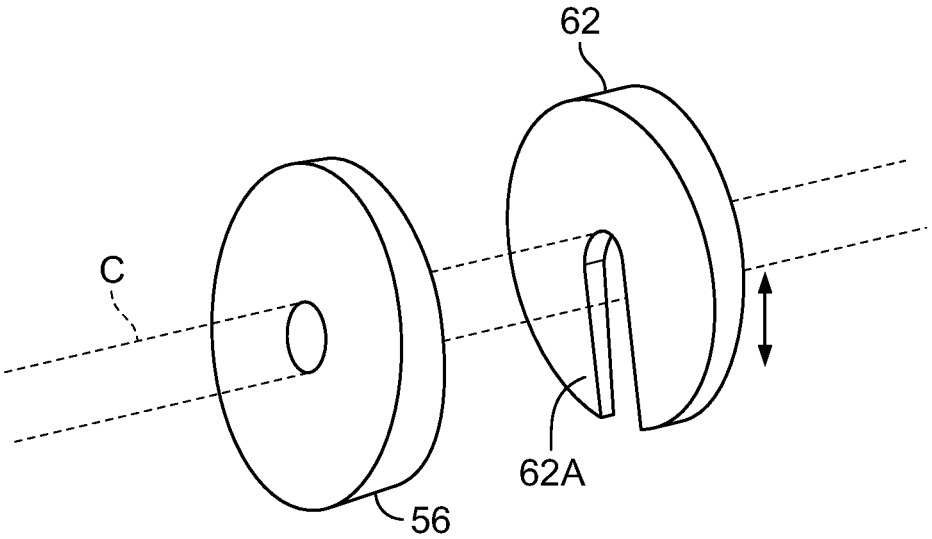
FIG. 10 is an exploded, perspective view of the tapered shims of FIG. 9.

Referring to FIGS. 9 and 10, the previously described retraction device has been deployed at column 14 to restore cable tension. The enlarged, internally threaded cup 46A is screwed onto threads 52A of barrel 52. Nut 50 is screwed onto the external threads 46B of sleeve 46 at the outside of brace 48. In this embodiment washer 58 is placed between nut 50 and brace 48. Tightening nut 50 will pull sleeve 46 outwardly, which will in turn pull barrel 52 outwardly. This motion of barrel 38 causes newly set tapered elements 54 to pull cable C outwardly and restore tension, for example, bringing the tension to 3 KIPS (3,000 pounds).

Barrel 52 will be held in its newly retracted position by inserting another tapered shim 62 between shim 56 and barrel 52. Slot 62A (FIG. 10) allows shim 62 to be placed over cable C.

It will be noted that shims 56 and 62 are oppositely beveled. Shim 62 may be tapped down, which causes cable C to move more deeply into slot 62A. This relative motion of shims 56 and 62 increases the overall spacing across the two shims. Effectively, shim 62 acts as a wedge and brings pressure to bear between plate 35 and barrel 52. In some embodiments shim 56 will be eliminated and shim 62 will be the only wedge-like device that is used to set the spacing between barrel 52 and plate 35. Also, an installer can be provided with a variety of shims of different thicknesses or bevel pitches to accommodate gaps of different sizes.

Thereafter, nut 50 can be removed so that brace 48 can be taken off sleeve 46. Thereafter, cup 46A of sleeve 46 will be unscrewed and removed from barrel 52. Finally, cable C can be trimmed and recess 14A can be filled with grout or sealed with a cover plate (not shown).

Figure 11:
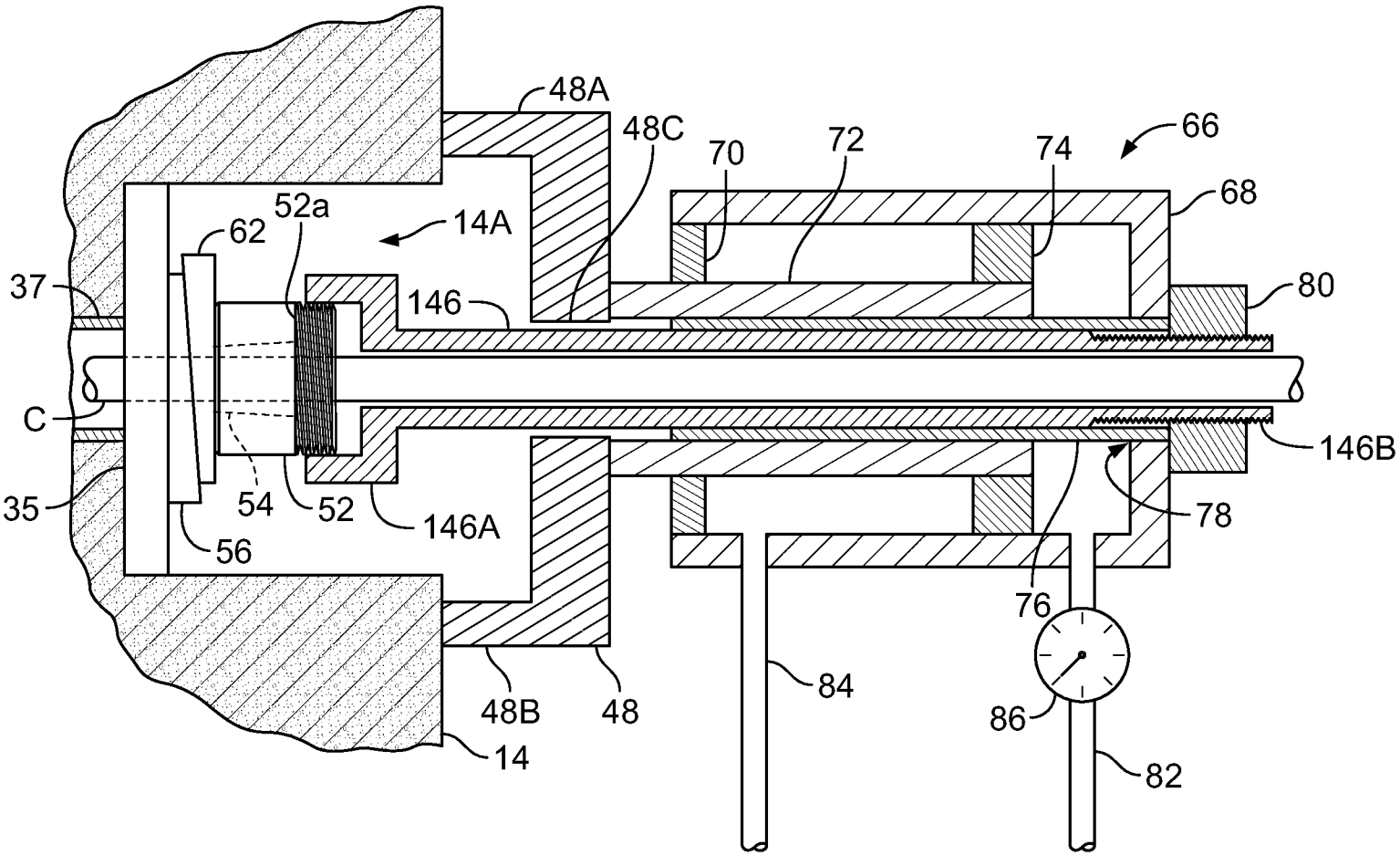
FIG. 11 is a fragmentary, vertical sectional view showing a retraction device that is an alternate to that of FIG. 9, and deployed at column 14 to restore cable tension.

Referring to FIG. 11, an alternative retraction device is described, but one that still acts on elements previously described. Components that are identical to those previously described in connection with FIG. 9 bear the same reference numerals. Components that have been modified but correspond to components of FIG. 9 will have the same reference numerals but raised by 100. As before, barrel 52 (containing tapered elements 54) will press against tapered shims 56 and 62 and plate 35. Column 14 is also the same as before and again includes pipe 37.

The retraction device of FIG. 11 has a sleeve 146 with an enlarged, internally threaded cup 146A screwed onto barrel 52. Sleeve 146 is inserted through bore 48C of previously described C-shaped yoke 48, which is also part of the retraction device. Yoke 48 is shown as a brace with arms 48A and 48B that can bear against column 14 to the outside of recess 14A.

Hydraulic ram 66 has a cylindrical casing 68 that has an open proximal end, which is closed with annular seal 70. Seal 70 encircles pusher tube 72 whose distal end is attached to annular piston 74. Pusher tube 72 is slidably mounted over tubular receptacle 76, whose distal end is affixed to circular aperture 78 in the distal end of casing 68.

Hydraulic ram 66 is installed by sliding its tubular receptacle 76 over sleeve 146 until pusher tube 72 engages yoke 48 as shown. Nut 80 is screwed onto the external threads 146B of sleeve 146 at the outside of casing 68.

Hydraulic pressure line 82 connects to the interior of casing 68 on the distal side of piston 74. Return line 84 accommodates inward motion of piston 74 in response to pressure applied by line 82. Casing 68, piston 74, pusher tube 72 and receptacle 76 provide a leak-proof chamber that accommodates the feed from line 82. Likewise, casing 68, piston 74, pusher tube 72, receptacle 76 and seal 70 provide a leak-proof chamber that accommodates the discharge into return line 82.

The inward motion of piston 74 causes pusher tube 72 to extend and bear against yoke 48. Consequently, casing 68 will move outwardly, which will pull sleeve 146 and barrel 52 outwardly. This motion of barrel 52 causes tapered elements 54 to pull cable C outwardly and restore tension. The operator can monitor the increasing tension by observing the pressure reading on gauge 86 until, for example, the tension reaches 3 KIPS (3,000 pounds).

Barrel 52 will be held in its newly retracted position by previously described, oppositely beveled shims 62 and 56. Basically, shim 62 may be tapped down, which causes cable C to retract further. This relative motion of shims 56 and 62 increases the overall spacing across the two shims. Effectively, shim 62 acts as a wedge and brings pressure to bear between plate 35 and barrel 52. The foregoing holds barrel 52 in its retracted position.

At this point, pressure is removed from line 82, eliminating the driving force on pusher tube 72. Thereafter, nut 80 can be removed so that hydraulic ram 66 can be removed by sliding receptacle 76 off of sleeve 146. Brace 48 will be taken off sleeve 146 as well. Thereafter, cup 146A of sleeve 146 will be unscrewed and removed from barrel 52. Finally, cable C can be trimmed and recess 14A can be filled with grout or sealed with a cover plate (not shown).

It is appreciated that various modifications may be implemented with respect to the above described embodiments. The foregoing can be used to set up barriers for various sites besides automobile parking facilities. In some cases a developer may need to string cables across a space for hanging fixtures, reinforcing building structures, stays for poles, etc. The terminal elements suspending the cables in the latter cases will still be considered columns and they can take various shapes. Instead of using a stressing jack, some embodiments will induce tension by winding a cable on a drum. In some embodiments the barrel containing the conical elements may be fitted with a number of screws that pass through the barrel at an angle and can be turned to project by an adjustable amount from the front of the barrel in order to set the barrel spacing. Instead of screwing a spacing device around the barrel, in some embodiments the spacing device may be a collar with a ratcheting mechanism that allows the collar to extend but not retract. In some cases the retraction device for retracting the barrel can use a pincer with sharp tips that lock into holes on the side of the barrel. In other embodiments the barrel may have distal, perpendicular stubs and the retraction device may have a collar with grooves that attach to the stubs to form a bayonet connection. Instead of using a C-shaped brace as a platform for retracting the barrel, some embodiments will secure a cantilever at the recess with a strap that encircles the column.

Obviously, many modifications and variations of the present invention are possible in light of the above teachings. It is therefore to be understood that within the scope of the appended claims, the invention may be practiced otherwise than as specifically described.

The invention claimed is:

1. A tensioning system for a cable that is to be strung through a plurality of columns and terminated at a last one of the plurality of columns, the tensioning system being disposed at the last one of the plurality of columns and comprising:

a barrel having a tapered cavity;

a wedging arrangement having a plurality of tapered elements slidably mounted in the tapered cavity, the plurality of tapered elements being adapted to encompass the cable and being oriented to favor unidirectional movement of the cable through the plurality of tapered elements, the wedging arrangement having opposite openings that allow the cable to emerge from opposite ends of the wedging arrangement;

a spacing device for engaging the barrel and the last one of the plurality of columns without directly engaging the cable, the spacing device being adjustable to set the spacing between the barrel and the last one of the plurality of columns, the wedging arrangement granting access to the cable in order to allow outward pulling of the cable and spacing device, and outward movement of the wedging arrangement relative to the barrel; and a retraction device coupled to the barrel for pulling the barrel in a direction away from the plurality of columns, the retraction device comprising:

a sleeve adapted to releasably connect to the barrel; and a yoke adapted to engage the sleeve and being operable to pull the barrel in a direction away from the last one of the plurality of columns.

2. A tensioning system according to claim 1 wherein the spacing device is mounted around the barrel and extends away from the barrel and engages the last one of the plurality of columns.

3. A tensioning system according to claim 2 wherein the last one of the plurality of columns has a recess, the barrel being mounted in the recess, the spacing device comprising a collar threaded on the barrel, turning the collar being effective to set an increased spacing of the barrel relative to the last one of the columns.

4. A tensioning system according to claim 3 wherein the last one of the plurality of columns has an annular plate mounted in its recess, the collar engaging the annular plate.

5. A tensioning system according to claim 1 wherein the spacing device comprises:

one or more tapered shims disposed between the barrel and the last one of the plurality of columns.

6. A tensioning system according to claim 1 wherein the retraction device is arranged to engage the barrel and the last one of the plurality of columns.

7. A tensioning system according to claim 1 wherein the yoke comprises:

a brace having a pair of arms for engaging the last one of the plurality of columns outside of the recess.

8. A tensioning system according to claim 7 wherein the sleeve is inserted though the brace, the yoke comprising a nut threaded on the sleeve to the outside of the brace, turning the nut being effective to pull the sleeve in a direction away from the last one of the plurality of columns.

9. A tensioning system according to claim 6 wherein the spacing device is mounted around the barrel and extends away from the barrel and engages the last one of the plurality of columns.

10. A tensioning system according to claim 9 wherein the last one of the plurality of columns has a recess with an annular plate, the spacing device comprising a collar threaded on the barrel, turning the collar being effective to engage the annular plate and set an increased spacing between the barrel and the last one of the plurality of columns.

11. A tensioning system according to claim to claim 1 wherein the spacing device comprises:

one or more tapered shims disposed between the barrel and the last one of the plurality of columns.

12. A tensioning system for a cable that is to be strung through a plurality of columns and terminated at a last one of the plurality of columns, the tensioning system being disposed at the last one of the plurality of columns and comprising:

a barrel having a tapered cavity;

a wedging arrangement having a plurality of tapered elements slidably mounted in the tapered cavity, the plurality of tapered elements being adapted to encompass the cable and being oriented to favor unidirectional movement of the cable through the plurality of tapered elements, the wedging arrangement having opposite openings that allow the cable to emerge from opposite ends of the wedging arrangement; and a spacing device for engaging the barrel and the last one of the plurality of columns without directly engaging the cable, the spacing device being adjustable to set the spacing between the barrel and the last one of the plurality of columns, the wedging arrangement granting access to the cable in order to allow outward pulling of the cable and spacing device, and outward movement of the wedging arrangement relative to the barrel;

wherein the spacing device comprises:

one or more tapered shims disposed between the barrel and the last one of the plurality of columns, wherein the one or more tapered shims comprises:

a pair of oppositely beveled, tapered shims disposed between the barrel and the last one of the plurality of columns, relative movement between the pair of shims being effective to set an increased spacing of the barrel relative to the last one of the columns.

13. A tensioning system according to claim 12 wherein the last one of the plurality of columns has a recess, the barrel being mounted in the recess.

14. A tensioning system according to claim 13 wherein the last one of the plurality of columns has mounted in its recess an annular plate, one of the pair of tapered shims engaging the annular plate.

15. A tensioning system according to claim 12 comprising:

a retraction device coupled to the barrel for pulling the barrel in a direction away from the plurality of columns.

16. A tensioning system for a cable that is to be strung through a plurality of columns and terminated at a last one of the plurality of columns, the tensioning system being disposed at the last one of the plurality of columns and comprising:

a barrel having a tapered cavity;

a wedging arrangement having a plurality of tapered elements slidably mounted in the tapered cavity, the plurality of tapered elements being adapted to encompass the cable and being oriented to favor unidirectional movement of the cable through the plurality of tapered elements, the wedging arrangement having opposite openings that allow the cable to emerge from opposite ends of the wedging arrangement;

a spacing device for engaging the barrel and the last one of the plurality of columns without directly engaging the cable, the spacing device being adjustable to set the spacing between the barrel and the last one of the plurality of columns, the wedging arrangement granting access to the cable in order to allow outward pulling of the cable and spacing device, and outward movement of the wedging arrangement relative to the barrel; and a retraction device coupled to the barrel for pulling the barrel in a direction away from the plurality of columns, wherein the retraction device is arranged to engage the barrel and the last one of the plurality of columns; wherein the spacing device comprises:

one or more tapered shims disposed between the barrel and the last one of the plurality of columns, and wherein the last one of the plurality of columns has a recess with an annular plate, the one or more tapered shims comprising:

a pair of oppositely beveled, tapered shims disposed between the barrel and the annular plate, relative movement between the pair of shims being effective to set an increased spacing of the barrel relative to the last one of the columns.

17. A tensioning system according to claim 16 wherein the retraction device comprises:

a sleeve adapted to releasably connect to the barrel; and a yoke adapted to engage the sleeve and being operable to pull the barrel in a direction away from the last one of the plurality of columns.

18. A tensioning method for a cable that can reach between a first one and a last one of a plurality of columns, wherein the first one and the last one of the plurality of columns each have an outward side facing away from the plurality of columns, and wherein the cable has a given end and a countervailing end, the method employing a mechanically adjustable spacing device and a plurality of tapered elements slidably mounted inside a barrel, the method comprising the steps of:

stringing the cable through the plurality of columns with the countervailing end of the cable being secured to the first one of the plurality of columns, the given end of the cable being strung about the last one of the plurality of columns;

with the barrel at the outward side of the last one of the plurality of columns, pulling the cable through the plurality of tapered elements to move the given end of the cable away from the plurality of columns;

at a side opposite the outward side of the last one of the plurality of columns, grasping the cable and pulling it away from the barrel to seat the plurality of tapered elements;

moving the barrel in a direction away from the last one of the plurality of columns; and applying the spacing device at the barrel to set the spacing between the barrel and the last one of the plurality of columns.

19. A tensioning method according to claim 18 employing a retraction device having a sleeve and a yoke, the step of moving the barrel being performed by:

connecting the sleeve to the barrel and inserting the sleeve through the yoke, the yoke being placed against the last one of the columns; and pulling the sleeve through the yoke to move the barrel away from the plurality of columns.

20. A tensioning method according to claim 18 wherein the spacing device includes an internally threaded collar, the step of applying the spacing device being performed by:

with the collar screwed around the barrel, turning the collar to engage the last one of the columns to set the spacing between the barrel and the last one of the columns.

* * * * *